US007008246B2

(12) United States Patent
Zhuge

(10) Patent No.: US 7,008,246 B2
(45) Date of Patent: Mar. 7, 2006

(54) ELECTRIC PLUG WITH REPLACEABLE HEAD UNIT

(76) Inventor: Rui Zhuge, West Side B2 Bldg, ZhanFeng Zone, HangCheng Industrial District, XiXiang Town, Baoan, Shenzhen (CN)

( * ) Notice: Subject to any disclaimer, the term of this patent is extended or adjusted under 35 U.S.C. 154(b) by 0 days.

(21) Appl. No.: 11/035,903

(22) Filed: Jan. 13, 2005

(65) Prior Publication Data

US 2005/0176281 A1 Aug. 11, 2005

(30) Foreign Application Priority Data

Feb. 6, 2004 (CN) ..... 2004200152754 U

(51) Int. Cl.
*H01R 29/00* (2006.01)

(52) U.S. Cl. ..... 439/173; 439/131; 439/172

(58) Field of Classification Search ..... 439/170–177, 439/131, 956, 638, 680, 372, 311–314, 166, 439/518, 218, 649
See application file for complete search history.

(56) References Cited

U.S. PATENT DOCUMENTS 5,613,863 A * 3/1997 Klaus et al. ..... 439/131
5,634,806 A * 6/1997 Hahn ..... 439/173
6,328,581 B1 * 12/2001 Lee et al. ..... 439/106
6,659,782 B1 * 12/2003 Wu ..... 439/131
6,669,495 B1 * 12/2003 Philips et al. ..... 439/170

* cited by examiner

*Primary Examiner*—P. Austin Bradley
*Assistant Examiner*—Edwin A. Leon
(74) *Attorney, Agent, or Firm*—Raymond Y. Chan; David and Raymond

(57) ABSTRACT

An electric plug includes a receptacle having an engaging seat and at least two resilient conductors spacedly provided on the engaging seat of the plug housing, and a detachable head unit including a supporting platform slidably fitted into the engaging seat in a detachably attaching manner, and at least two plugging heads which are spacedly extended from the supporting platform and are sized and shaped adapted for fitting into an electric socket. Each plugging head has an affixing end penetrated through the supporting platform as an electric contacting link, wherein when the supporting platform is slid in the engaging seat to detachably mount the detachable head unit to the receptacle, the two resilient conductors are conductively contacted with the affixing ends of the plugging heads respectively so as to electrically connect the plugging heads with the AC circuitry of the receptacle.

10 Claims, 4 Drawing Sheets

ELECTRIC PLUG WITH REPLACEABLE HEAD UNIT

BACKGROUND OF THE PRESENT INVENTION

1. Field of Invention

The present invention relates to an electric plug for electrically connecting an electric appliance with an electric socket, and more particularly to an electric plug, wherein a detachable head unit of the electric plug can be selectively interchanged for adapting to different electric sockets with respect to the different standards of the countries.

2. Description of Related Arts

Most electric appliances, such as charger or AC-to-DC inverter, require an AC power input. Such electric appliances generally comprise an elongated electric cable and an electric plug adapted to electrically plug into an electric socket of a power electric.

No matter which types of the electric plugs are incorporated, the manufacturer only provides the electric plug corresponding to the safety standard of the country which the electric appliances are sale therein. In other words, there are different safety standards around the world, such as CCC standards in China, UL standards in the United States, UK standards in UK and GS standards in German, etc, the electric plug is not changeable such that even the manufacturers manufacture the same electric appliances, they have to change the corresponding electric plugs before the electric appliances are shipped to different countries. In addition, with the rapid development of international exchanges and world trade, it becomes a necessary approach in the single-systemization of world economics market and the internationality of electric appliances. In order to meet the different safety standards, the user and/or the manufacturer merely incorporate with an adapter for the electric plug. However, such adapter not only enlarges the size of the electric plug but also increases the manufacturing cost of the electric appliance.

SUMMARY OF THE PRESENT INVENTION

A main object of the present invention is to provide an electric plug, wherein a detachable head unit of the electric plug can be selectively interchanged for adapting to different electric sockets with respect to the different standards of the countries.

Another object of the present invention is to provide an electric plug, wherein the user is able to interchange the detachable head unit from the plug housing to fit the corresponding electric socket. In addition, the manufacturer is able to provide the corresponding detachable head unit for the electric appliance to meet the safety standard of the country without replacing the entire electric plug, so as to reduce the manufacturing cost of the electric appliance.

Accordingly, in order to accomplish the above objects, the present invention provides an electric plug for an electric socket, comprising:

a receptacle comprising a plug housing having an engaging seat, at least two resilient conductors spacedly provided on the engaging seat of the plug housing, a AC circuitry received in the plug housing, and an electric cable which is extended from the plug housing and is electrically connected to the resilient conductors through the AC circuitry; and at least a detachable head unit comprising a supporting platform slidably fitted into the engaging seat in a detachably attaching manner, and at least two plugging heads which are spacedly extended from the supporting platform and are sized and shaped adapted for fitting into the electric socket, wherein each of the plugging heads has an affixing end penetrated through the supporting platform as an electric contacting link, wherein when the supporting platform is slid in the engaging seat of the plug housing to detachably mount the detachable head unit to the receptacle, the two resilient conductors are conductively contacted with the affixing ends of the plugging heads respectively so as to electrically connect the plugging heads with the AC circuitry.

These and other objects, features, and advantages of the present invention will become apparent from the following detailed description, the accompanying drawings, and the appended claims.

DETAILED DESCRIPTION OF THE PREFERRED EMBODIMENT

Figure 1:
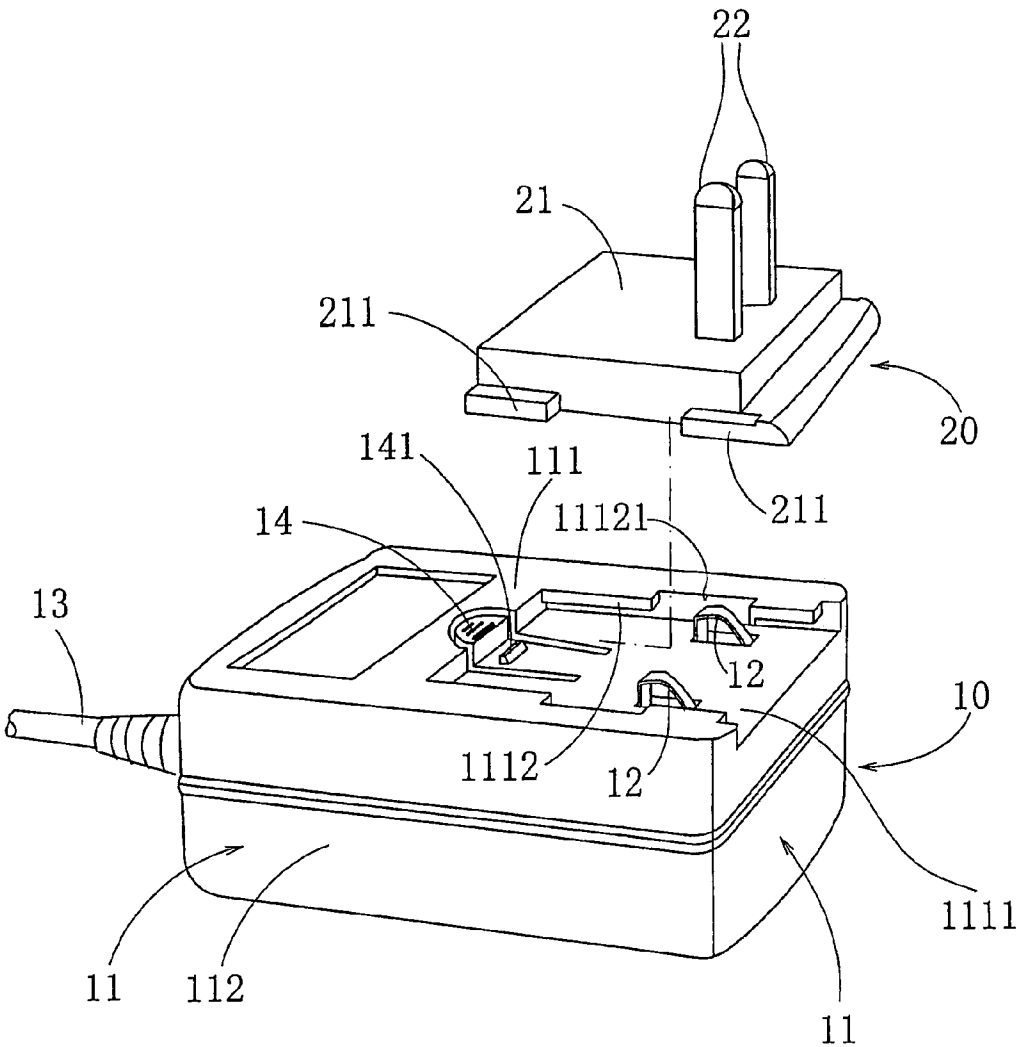
FIG. 1 is an exploded perspective view of an electric plug according to a preferred embodiment of the present invention.

Referring to FIG. 1 of the drawings, an electric plug for an electric socket according to a preferred embodiment of the present invention is illustrated, wherein the electric plug comprises a receptacle 10 and at least a detachable head unit 20 detachably mounting to the receptacle 10.

The receptacle 10 comprises a plug housing 11 having an engaging seat 1111, at least two resilient conductors 12 spacedly provided on the engaging seat 1111 of the plug housing 11, a AC circuitry received in the plug housing 11, and an electric cable 13 which is extended from the plug housing 11 and is electrically connected to the resilient conductors 12 through the AC circuitry.

The plug housing 11 comprises an upper casing 111 and a lower casing 112 mounted thereto to form a box-shape structure to receive the AC circuitry between the upper and lower casings 111, 112, wherein the engaging seat 1111 is formed on the upper casing 111 to detachably engage with the detachable head unit 20. Accordingly, the engaging seat 1111 has two sliding grooves 1112 sidewardly formed at two side edges of the engaging seat 1111 respectively and two groove accesses 11121 formed at two sliding grooves 1112 respectively.

The resilient conductors 12 are spacedly mounted on the engaging seat 1111 of the plug housing 11 at a position between the two sliding grooves 1112. Each of the resilient conductors 12 are movably protruded from the engaging seat 1111 wherein the resilient conductors 12 are adapted to be pressed on the engaging seat 1111 when an external force is pressed on the resilient conductors 12.

The detachable head unit 20 comprises a supporting platform 21 slidably fitted into the engaging seat 1111 in a detachably attaching manner, and at least two plugging heads 22 which are spacedly extended from the supporting platform 21 and are sized and shaped adapted for fitting into the electric socket, wherein each of the plugging heads 22 has an affixing end 221 penetrated through the supporting platform 21 as an electric contacting link. When the supporting platform 21 is slid in the engaging seat 111 of the plug housing 11 to detachably mount the detachable head unit 20 to the receptacle 10, the two resilient conductors 12 are conductively contacted with the affixing ends 221 of the plugging heads 22 respectively so as to electrically connect the plugging heads 22 with the AC circuitry. In other words, the two resilient conductors 12 are two spring wires protruding on the engaging seat 1111 adapted for applying an urging force against the supporting platform 21 to not only retain the supporting platform 21 at the engaging seat 1111 but also ensure the conductively contact with the affixing ends 221 of the plugging heads 22.

Accordingly, the supporting platform 21 comprises a plurality of engaging flanges 211 integrally protruded from two side edges of the supporting platform 21 wherein the engaging flanges 211 are slidably engaged with the sliding grooves 1112 to slidably mount the supporting platform 21 to the engaging seat 111 of the plug housing 11. It is worth to mention that a thickness of each of the engaging flanges 211 is slightly smaller than a width of the sliding groove 1112 such that the engaging flanges 211 are fittingly slotted into the sliding groove 1112 to detachably mount the supporting platform 21 on the engaging seat 111. In other words, the engaging flanges 211 are slid into the sliding grooves 1112 through the groove accesses 11121 respectively to retain the supporting platform 21 at the engaging seat 111 so as to prevent an unwanted lateral movement of the detachable head unit 20 with respect to the receptacle 10.

It is worth to mention that the plugging heads 22 are designed for a particular safety standard of the electric socket. Therefore, the receptacle 10 of the present invention can incorporate with different types of detachable head unit 20A, 20B, 20C, 20D, as shown in FIGS. 3A to 3D, which meet the safety standards of different countries such as China, United States, German, and British. In other words, the detachable head units 20, 20A, 20B, 20C, 20D are interchangeable to fit into the receptacle 10. Thus, the electric cable 13 is extended from the plug housing 11 to electrically connect to the AC circuitry so as to prevent the electric leakage of the present invention. Accordingly, the AC circuit can be a AC-to-DC inverting circuit, a rectifying circuit, a charging circuit or circuit for shaving device that can be selectively received in the plug housing 11.

The electric plug further comprises means for locking the supporting platform 21 on the engaging seat 1111. The locking means comprises a locking flange 212 formed on the supporting platform 21, a locking latch 141 movably provided at the engaging seat 1111 and aligned with the locking flange 212 when the supporting platform 21 is slid on the engaging seat 1111, and an actuation button 14 provided on the receptacle 10 to actuate the locking latch 141 to releasably engage with the locking flange 212 so as to lock up the supporting platform 21 on the engaging seat 1111. When the actuation button 14 is depressed to release the locking engagement between the locking latch 141 and the locking flange 212, the detachable head unit 20 is adapted to be detached from the receptacle 10. The locking flange 212 is formed on a bottom side of the supporting platform 21 and the locking latch 141 is movably extended at an inner edge of the engaging seat 1111 to detachably engage with the locking flange 212 when the supporting platform 21 is slid on the engaging seat 1111.

Figure 2:
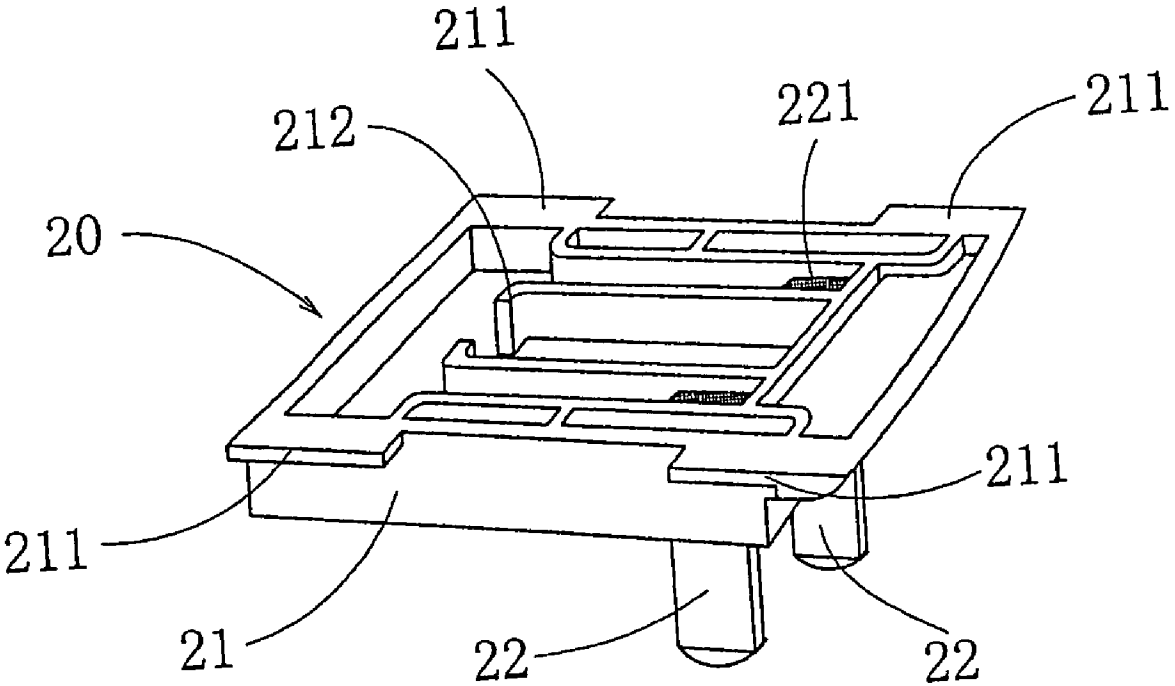
FIG. 2 is a perspective view of a detachable head unit of the electric plug according to the above preferred embodiment of the present invention.
Figure 3A:
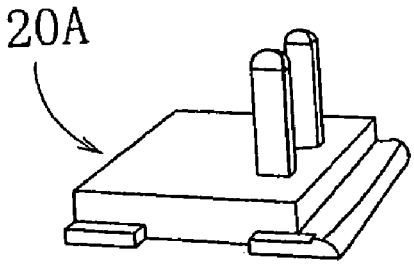
FIGS. 3A to 3D are perspective views of the detachable head unit according to the above preferred embodiment of the present invention, illustrating various types of plugging heads for different safety standards in the world.
Figure 3B:
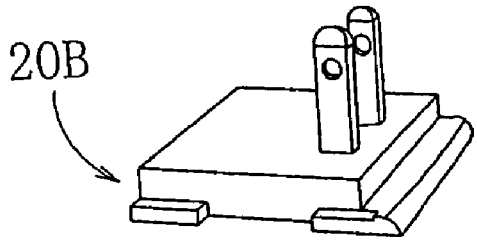
Figure 3C:
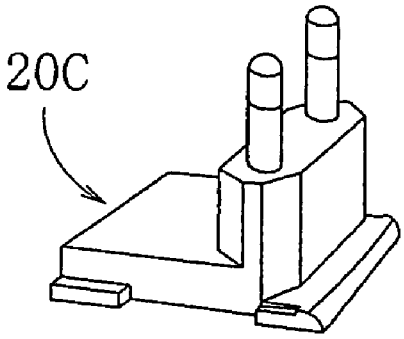
Figure 3D:
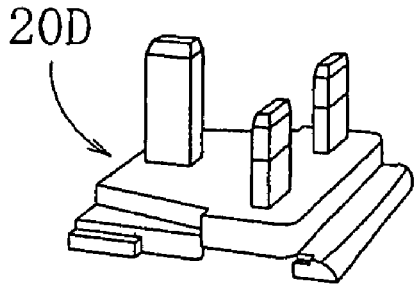
Figure 4C:
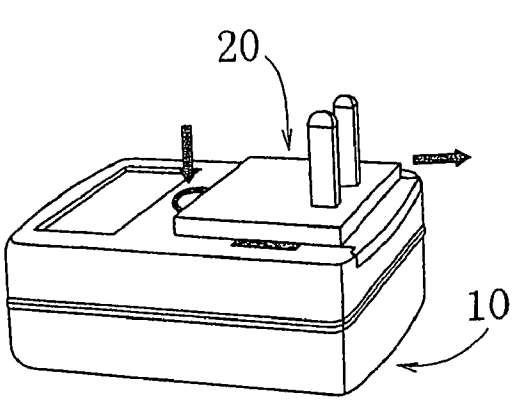
FIGS. 4A to 4C illustrate the detachably attaching operation of the electric plug according to the above preferred embodiment of the present invention.
Figure 4B:
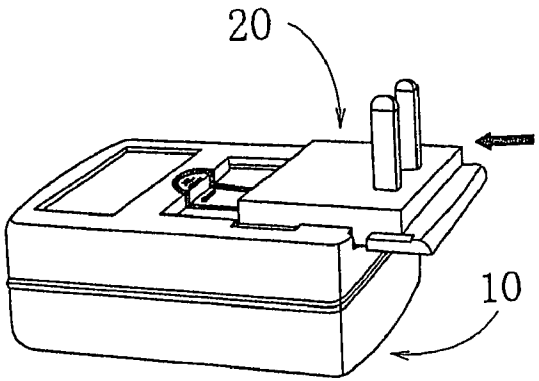
Figure 4A:
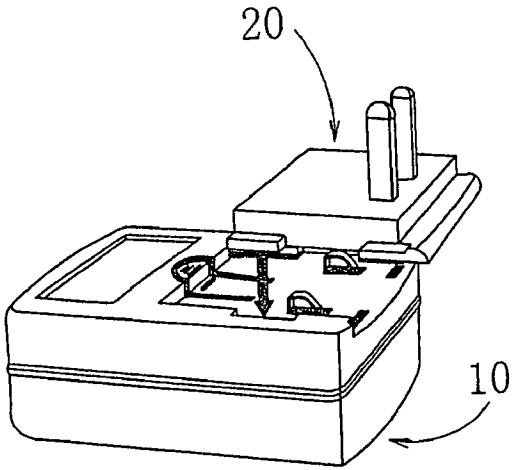

As shown in FIGS. 2 and 4, in order to mount the detachable head unit 20 to the receptacle 10, the engaging flanges 211 are slid into the sliding grooves 1112 through the groove accesses 11121 respectively, as shown in FIG. 4A. Then, the supporting platform 21 is slid in the engaging seat 1111, as shown in FIG. 4B, until the locking latch 141 is engaged with the locking flange 212 to lock up the supporting platform 21 at the engaging seat 1111, as shown in FIG. 4C. Therefore, the two resilient conductors 12 are conductively contacted with the affixing ends 221 of the plugging heads 22 respectively so as to electrically connect the plugging heads 22 with the AC circuitry. For interchanging the detachable head unit 20, the user is able to press on the actuation button 14 to release the locking engagement between the locking latch 141 and the locking flange 212 such that the detachable head unit 20 is adapted to be slidably detached from the receptacle 10.

One skilled in the art will understand that the embodiments of the present invention as shown in the drawing and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electric plug for an electric socket, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a detachable head unit comprising a supporting platform slidably fitted into said engaging seat in a detachably attaching manner, and at least two plugging heads which are spacedly extended from said supporting platform and are sized and shaped adapted for fitting into said electric socket, wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

2. An electric plug for an electric socket, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a detachable head unit comprising a supporting platform slidably fitted into said engaging seat in a detachably attaching manner, and at least two plugging heads which are spacedly extended from said supporting platform and are sized and shaped adapted for fitting into said electric socket, wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said engaging seat has two sliding grooves sidewardly formed at two side edges of said engaging seat respectively and two groove accesses formed at two sliding grooves respectively, wherein said supporting platform comprises a plurality of engaging flanges integrally protruded from two side edges of said supporting platform, wherein said engaging flanges are slidably engaged with said sliding grooves at said groove accesses respectively to slidably mount said supporting platform to said engaging seat of said plug housing; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

3. An electric plug for an electric socket, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a detachable head unit comprising a supporting platform slidably fitted into said engaging seat in a detachably attaching manner, and at least two plugging heads which are spacedly extended from said supporting platform and are sized and shaped adapted for fitting into said electric socket, wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said two resilient conductors are two spring wires protruding on said engaging seat adapted for applying an urging force against said supporting platform to not only retain said supporting platform at said engaging seat but also ensure a conductively contact with said affixing ends of said plugging heads; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

4. An electric plug for an electric socket, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a detachable head unit comprising a supporting platform slidably fitted into said engaging seat in a detachably attaching manner, and at least two plugging heads which are spacedly extended from said supporting platform and are sized and shaped adapted for fitting into said electric socket, wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said engaging seat has two sliding grooves sidewardly formed at two side edges of said engaging seat respectively and two groove accesses formed at two sliding grooves respectively, wherein said supporting platform comprises a plurality of engaging flanges integrally protruded from two side edges of said supporting platform, wherein said engaging flanges are slidably engaged with said sliding grooves at said groove accesses respectively to slidably mount said supporting platform to said engaging seat of said plug housing, wherein said two resilient conductors are two spring wires protruding on said engaging seat adapted for applying an urging force against said supporting platform to not only retain said supporting platform at said engaging seat but also ensure a conductively contact with said affixing ends of said plugging heads; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

5. The electric plug, as recited in claim 4, wherein said AC circuitry is a circuit selected from the group consisting of a AC-to-DC inverting circuit, a rectifying circuit, a charging circuit and a circuit for shaving device.

6. An electric plug for electric sockets with various safety standards, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a plurality of detachable head units, wherein each of said detachable head unit comprising a supporting platform slidably fitted into said engaging seat in a detachably attaching manner, and at least two plugging heads spacedly extended from said supporting platform, wherein said plugging heads of said detachable head units are sized and shaped adapted for fitting into said safety standards of said electric sockets, wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

7. An electric plug for electric sockets with various safety standards, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a plurality of detachable head units, wherein each of said detachable head unit comprising a supporting platform slidably fitted into said engaging seat in a detachably attaching manner, and at least two plugging heads spacedly extended from said supporting platform, wherein said plugging heads of said detachable head units are sized and shaped adapted for fitting into said safety standards of said electric sockets wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said engaging seat has two sliding grooves sidewardly formed at two side edges of said engaging seat respectively and two groove accesses formed at two sliding grooves respectively, wherein said supporting platform comprises a plurality of engaging flanges integrally protruded from two side edges of said supporting platform, wherein said engaging flanges are slidably engaged with said sliding grooves at said groove accesses respectively to slidably mount said supporting platform to said engaging seat of said plug housing; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

8. An electric plug for electric sockets with various safety standards, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a plurality of detachable head units, wherein each of said detachable head unit comprising a supporting platform slidably fitted into said engaging seat in a detachably attaching manner, and at least two plugging heads spacedly extended from said supporting platform, wherein said plugging heads of said detachable head units are sized and shaped adapted for fitting into said safety standards of said electric sockets wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said two resilient conductors are two spring wires protruding on said engaging seat adapted for applying an urging force against said supporting platform to not only retain said supporting platform at said engaging seat but also ensure a conductively contact with said affixing ends of said plugging heads; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

9. An electric plug for electric sockets with various safety standards, comprising:

a receptacle comprising a plug housing having an engaging seat, at least two resilient conductors spacedly provided on said engaging seat of said plug housing, a AC circuitry received in said plug housing, and an electric cable which is extended from said plug housing and is electrically connected to said resilient conductors through said AC circuitry;

a plurality of detachable head units, wherein each of said detachable head unit comprising a supporting platform slidably fitted into said engaging seat in a detachably attaching manner, and at least two plugging heads spacedly extended from said supporting platform, wherein said plugging heads of said detachable head units are sized and shaped adapted for fitting into said safety standards of said electric sockets wherein each of said plugging heads has an affixing end penetrated through said supporting platform as an electric contacting link, wherein when said supporting platform is slid in said engaging seat of said plug housing to detachably mount said detachable head unit to said receptacle, said two resilient conductors are conductively contacted with said affixing ends of said plugging heads respectively so as to electrically connect said plugging heads with said AC circuitry, wherein said engaging seat has two sliding grooves sidewardly formed at two side edges of said engaging seat respectively and two groove accesses formed at two sliding grooves respectively, wherein said supporting platform comprises a plurality of engaging flanges integrally protruded from two side edges of said supporting platform, wherein said engaging flanges are slidably engaged with said sliding grooves at said groove accesses respectively to slidably mount said supporting platform to said engaging seat of said plug housing, wherein said two resilient conductors are two spring wires protruding on said engaging seat adapted for applying an urging force against said supporting platform to not only retain said supporting platform at said engaging seat but also ensure a conductively contact with said affixing ends of said plugging heads; and a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat.

10. The electric plug, as recited in claim 9, wherein said AC circuitry is a circuit selected from the group consisting of a AC-to-DC inverting circuit, a rectifying circuit, a charging circuit and a circuit for shaving device.

* * * * *